United States Patent [19]

Falla

[11] Patent Number: 4,767,377

[45] Date of Patent: Aug. 30, 1988

[54] BRASSIERE

[75] Inventor: Gloria M. Falla, Demarest, N.J.

[73] Assignee: Warnaco, Inc., Bridgeport, Conn.

[21] Appl. No.: 104,441

[22] Filed: Oct. 2, 1987

[51] Int. Cl.[4] ..... A41C 3/00

[52] U.S. Cl. ..... 450/65; 450/76; 450/52

[58] Field of Search ..... 450/52, 65, 70, 73, 450/76

[56] References Cited

U.S. PATENT DOCUMENTS

| | | | |
|---|---|---|---|
| 1,882,023 | 10/1932 | Malnick . | |
| 2,548,823 | 4/1951 | Rosenthal . | |
| 2,623,211 | 12/1952 | Brown . | |
| 2,719,975 | 10/1955 | Rosenthal . | |
| 2,857,916 | 10/1958 | Garson | 450/65 |
| 2,881,765 | 4/1959 | Sloate | 450/65 |
| 2,883,988 | 4/1959 | Lee . | |
| 2,971,513 | 2/1961 | Gingras . | |
| 3,353,540 | 11/1967 | Erteszek | 450/65 |
| 3,717,154 | 2/1973 | Spetalnik . | |
| 4,419,997 | 12/1983 | Cole et al. | 450/65 |

FOREIGN PATENT DOCUMENTS

| | | | |
|---|---|---|---|
| 2541440 | 3/1977 | Fed. Rep. of Germany | 450/76 |

*Primary Examiner*—Louis K. Rimrodt
*Assistant Examiner*—J. L. Olds
*Attorney, Agent, or Firm*—Amster, Rothstein & Ebenstein

[57] ABSTRACT

A brassiere comprises two bra cups, each including an inner cup and an outer cup peripherally joined together to form upper, lower, inner side and outer side margins. Each of the outer cups is formed of elastic material and each of the inner cups comprises a segment formed of non-elastic material extending upwards from the lower margin and a yoke formed of elastic material connecting the top and sides of the non-elastic segment to the upper, inner side and outer side margins. Thus, the elastic yoke of the inner cup permits the outer cup to accommodate to the breast of the wearer, while the non-elastic segment of the inner cup provides support in the medial region thereof.

13 Claims, 1 Drawing Sheet

BRASSIERE

BACKGROUND OF THE INVENTION

The present invention relates to brassieres, and more particularly to "stretch"brassieres.

U.S. Pat. No. 2,719,975 and U.S. Pat. No. 2,971,513 disclose brassieres which have bra cups of a composite construction which combines a non-elastic segment and an elastic segment. The elastic segment permits the cup to stretch and accommodate to the bust of the wearer, while the non-elastic segment provides the desired bust-supporting function. Such composite cup constructions typically fail to meet the high fashion decolletage requirement for a successful brassiere in today's market. While a bra cup mixture of elastic and inelastic fabrics can provide the wearer with the comfort of a stretch bra and at least a portion of the support of a non-elastic bra, the known brassieres fail to combine these desirable properties with the attractive appearance demanded by the fashion conscious.

U.S. Pat. No. 2,883,988 discloses a brassiere which has a two ply bra cup comprising an inner cup of a light thin lining fabric and an outer cup which is a composite of an inelastic fabric and a lacey trimming material. The use of a composite construction for the outer cup also fails to meet the high fashion decolletage requirements for a successful brassiere in today's market where the appearance of a seam or stitch line is totally rejected by women who prefer the smooth drape of clinging fabric uninterrupted by seam line bulges and the like.

Accordingly, it is an object of the present invention to provide a brassiere which combines the comfort of elasticity, the support of non-elasticity and the attractiveness of a bra with a non-composite sole or outer cup.

Another object is to provide such a brassiere which utilizes a two-ply cup, an outer cup providing an attractive appearance and an inner cup combining the composite functions of support and comfort.

A further object is to provide such a brassiere which is of simple economic construction, inexpensive to manufacture, and easy to maintain.

SUMMARY OF THE INVENTION

It has now been found that the above and related objects are obtained in a brassiere comprising two bra cups, each including an inner cup and an outer cup peripherally joined together to form upper, lower, inner side and outer side margins. Back band means contact the outer side margins of the bra cups about the back of the wearer, and chest band means connect the inner side margins of the bra cups in the front of the wearer. Each of the outer cups is formed of elastic material, and each of the inner cups comprises a segment formed of non-elastic material extending upwards from the lower margin and a yoke formed of elastic material connecting the top and sides of the non-elastic segment to the upper, inner side and outer side margins. Thus the elastic yoke of the inner cup permits the outer cup to accommodate to the breast of the wearer, while the non-elastic segment of the inner cup provides support in the medial region thereof.

Preferably the segment and yoke of the inner cup are connected to each other without overlapping, and the outer cup is coextensive with the inner cup and conceals the connection of the segment and yoke during use of the brassiere.

In a preferred embodiment, in the inner cup the elastic yoke is chevron-shaped, and the non-elastic segment comprises at least 50 percent of the total area of the inner cup and extends above the bra cup point. The non-elastic material is fiberfill.

The brassiere preferably additionally comprises underwire support means extending through the lower margin and into the inner side and outer side margins, and shoulder strap means connecting the upper margins of each of the bra cups to the back hand means over the shoulders of the wearer.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
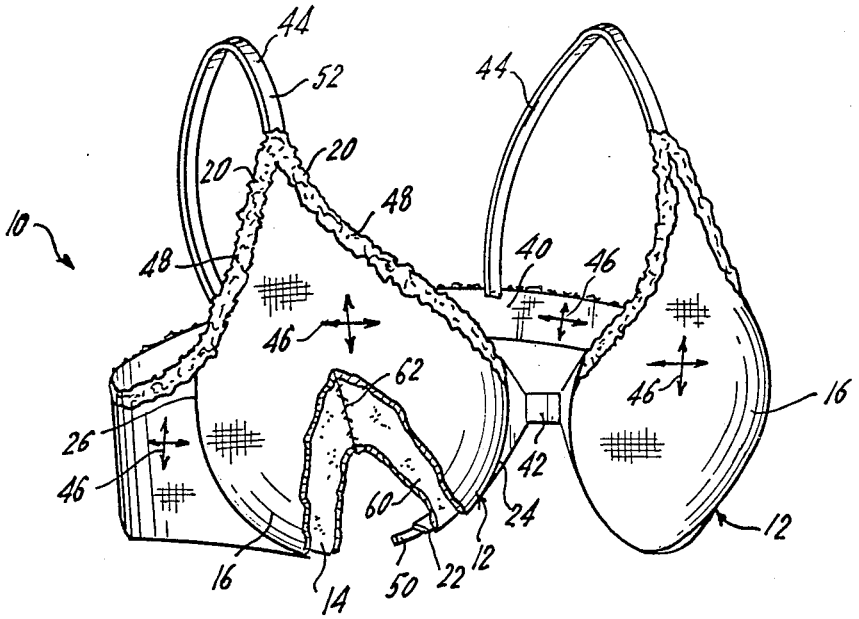
FIG. 1 is an isometric view of a brassiere according to the present invention, with portions thereof cut away to reveal details of internal construction.

Referring now to the drawing, and in particular to FIG. 1 thereof, therein illustrated is a brassiere according to the present invention, generally designated by the reference numeral 10. The brassiere 10 in its conventional aspects comprises a pair of bra cups generally designated by the reference numeral 12, each including an inner cup 14 and an outer cup 16 peripherally joined together (see FIG. 2) to form an upper margin 20, a lower margin 22, an inner side margin 24 and an outer side margin 26. As the two bra cups 12 are for the purposes of the present invention of identical design and construction, only the bra cup 12 for the right breast of the wearer will be described, this being the bra cup having portions cut away in the FIG. 1 and illustrated from the rear in FIG. 2.

The brassiere 10 further comprises back band means 40 for connecting the outer margin 26 of the bra cups 12 about the back of the wearer, chest band means 42 for connecting the inner margins 24 of the bra cups 12 in the front of the wearer, and optional shoulder strap means 44 for connecting the upper margins 20 of each of the bra cups 12 to the back band means 40 over the shoulders of the wearer. Typically the back band means 40 is formed of an elastic or stretchable material, as indicated by the crossed double-headed arrows 46; the chest band means 42, often called a front gore, may be constructed of the same material or an inelastic material. The shoulder strap means 44 may be formed of inelastic material, elastic material stretchable in transverse directions, or elastic material stretchable only longitudinally. A lacey frill 48 may be provided along the upper margin 20, and extending slightly outwardly therefrom, and along the top of the chest band means 40 either to assist in concealing the outline of the brassiere 10 under clothing or simply for aesthetic reasons.

The illustrated bra 10 is of underwire construction and employs a wire or underwire support means 50 extending through the lower margin 22 and at least partially into the inner and outer margins 24, 26. In other constructions, such as the wireless "soft cup" construction, the back band means 40 may extend all the way around the front of the brassiere, below the bra cups 12, to maintain the bottom margins 22 flat against the wearer.

It will be appreciated that the brassiere 10 as described hereinabove is conventional in nature and may take a variety of different forms well known to those skilled in the art of brassiere making. For example, as already noted, instead of the underwire construction illustrated, a "soft cup" construction may be used. While the shoulder strap means 44 is illustrated as composed of two parallel shoulder straps 52 in FIG. 1, other constructions may be utilized wherein the shoulder straps crisscross one another or form a T-back (i.e., meet in a common yoke across the back of the wearer). While stretch brassieres generally utilize shoulder strap means in one form or another, the principles of the present invention also apply to strapless brassieres which do not utilize any shoulder straps means whatsoever. Lace or other attractive material may be disposed at various places on the brassiere, as illustrated or in other locations, to hide the outline of the brassiere, to provide a smooth or smoothly and regularly patterned appearance under clinging clothing, or simply to provide an attractive appearance when uncovered.

The brassiere 10 typically includes such additional features as an openable closure mechanism (not shown) disposed either in the chest band means 42 or back band means 40, strap length adjustment means (not shown) in the shoulder strap means 44, and the like. The openable closure mechanism may be hooks and eyelets, interlocking plastic tabs, or the like. These and many other features may be included, varied or omitted without affecting the nature of applicability of the principles of the present invention as described hereinbelow.

Turning now to the non-conventional aspects of the present invention, the outer cup 16 of each bra cup 12 is formed of an elastic material, as indicated by the crossed double-headed arrows 46. Except where the context clearly indicates the contrary, the term "elastic material" as used in the specification and claims identifies a material which exhibits substantial elasticity in transverse axes rather than simply along a single axis. Such materials have been utilized in "stretch" bras for many years and are well known to those skilled in the brassiere manufacturing art. The elastic material utilized in outer cup 16 is selected for its aesthetic value and its ability to at least partially conceal the less attractive aspects of the inner cup 14. A preferred material is patterned Lycra (a trade name of DuPont for its elastomeric synthetic fibers) although like materials may also be used, whether patterned or not. The outer cup 16 is co-extensive with the inner cup 14 and provides a smooth or smoothly and regularly patterned overlay therto.

By way of contrast with the unitary nature of the outer cup 16, the inner cup 14 is of a composite nature. The inner cup 14 comprises a segment 60 formed of non-elastic material extending upwards from the lower margin 22 of the bra cup 12. The non-elastic segment 60 comprises preferably at least 50% of the total surface area of the inner cup 14 and extends above the bra cup point. The segment 60 may be fiberfill or other materials well known to those skilled in the brassiere manufacturing art as having only minimal elastic properties or stretch in any direction. The non-elastic segment 60 may be formed of either molded material or natural fabric cut and sewn to provide good bust support. The segment 60 is generally symmetrically distributed about an axis extending between the shoulder strap 44 and the middle of the lower margin 22, and passing through the bra cup point. The sides 66 of the segment 60 extend farthest out from the axis adjacent the lower margin 22 and converge toward the axis as the segment top 68 approaches the shoulder strap 44. For additional support, a line of stitching 62 may extend along this axis from the lower margin 22 through the bra cup point.

Figure 2:
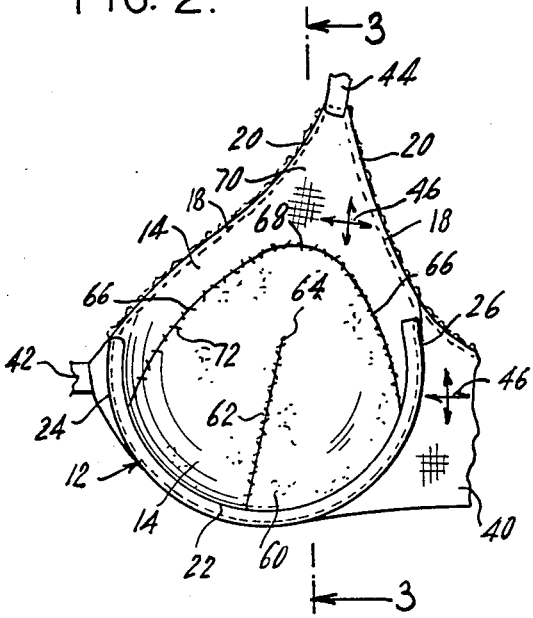
FIG. 2 is a fragmentary rear elevation view thereof.
Figure 3:
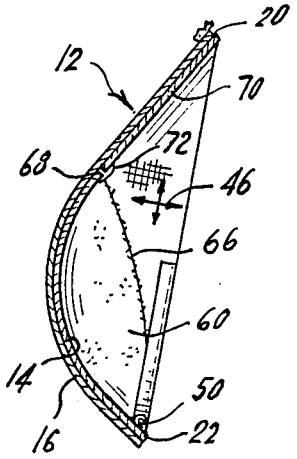
FIG. 3 is a side elevation view thereof, partially in cross section, taken along the line 3—3 of FIG. 2.

The inner cup 14 further comprises a sling or yoke 70 formed of elastic material (see FIGS. 2 and 3). The yoke 70 connects the top 68 and the sides 66 of the segment 60 to the upper margin 20 and the inner and outer side margins 24, 26, respectively. The yoke 70 is chevron shaped, the apex of the yoke receiving the upper point 68 of the segment 60. While the yoke 70 is illustrated as chevron shaped, obviously any suitable sling configuration may be utilized which provides adequate support for the top 68 and substantial portions of the sides 66 of the segment 60. A preferred yoke material is a smooth Lycra, typically lighter and thinner than that employed in the outer cup 16, although other elastomeric synthetic fibers and like materials may also be used. By virtue of this composite construction, the elastic yoke 70 of the inner cup 14 permits the elastic outer cup 16 to accommodate to the breast of the wearer substantially without hinderance from the inner cup 14, while the non-elastic segment 60 of the inner cup 14 provides support in the medial region of such inner cup, precisely where it is most needed.

As best illustrated in FIG. 3, in order not to create in inner cup 14 any unnecessary bump or protrusion which might be reflected in the outer cup 16, the top 68 and sides 66 of the segment 60 are stitched to the elastic yoke 70 without the two materials 60, 70 overlying or overlapping one another. Rather the two materials 60, 70 are only brought into end-to-end or close to end-to-end engagement by the "open merrow" stitching 72. The actual connection of the segment 60 and yoke 70 is concealed during use of the brassiere 10 by the outer cup 16.

The segment 60 is, in effect, a reduced size bra cup. Wtih the yoke 70 it forms an inner cup 14 which is co-extensive with the outer cup 16. The two cups 14 and 16 need not be absolutely coextensive, although this is generally desirable in order to obtain the maximum effect from the elastic nature of the relatively small area of the yoke 70. To whatever extent the full area of the elastic yoke 70 is not employed (that is, to whatever extent the peripheral joining of the inner and outer cups is not on the outermost periphery of the yoke 70), the fully elastic nature of the outer cup 16 is underutilized due to the restrictive effect exerted on the outer cup 16 by the inner cup 14 as a result of the presence therein of the inelastic segment 60.

To summarize, the brassiere of the present invention affords the comfort of elasticity, the support of non-elasticity precisely where needed, and the attractiveness of a bra with a non-composite sole or outer cup. More particularly, the present invention provides a brassiere with a two ply cup, an outer cup providing an attractive appearance and an inner cup combining the composite functions of support and comfort. The brassiere is of simple, economic construction, inexpensive to manufacture and easy to maintain.

Now that the preferred embodiments have been shown and described in detail, various modifications and improvements thereon will become readily apparent to those skilled in the art. Accordingly, the spirit and scope of the present invention is to be limited only be the appended claims, and not by the foregoing description.

I claim:

1. In a brassiere comprising (A) two bra cups, each including an inner cup and an outer cup peripherally joined together to form upper, lower, inner side and outer side margins;

(B) back band means for connecting said outer side margins of said bra cups about the back of the wearer; and (C) chest band means for connecting said inner side margins of said bra cups in the front of the wearer;

the improvement wherein each of said outer cups is formed of elastic material and each of said inner cups comprises a segment formed of non-elastic material extending upwards from said lower margin and a yoke formed of elastic material connecting the top and sides of said non-elastic segment to said upper, inner side and side outer margins; whereby said elastic yoke of said inner cup permits said outer cupto accommodate to the breast of the wearer while said non-elastic segment of said inner cup provides support in the medial region thereof.

2. The brassiere of claim 1 wherein said non-elastic segment comprises at least 50 percent of the total area of said inner cup.

3. The brassiere of claim 1 wherein said non-elastic segment extends above the bra cup point.

4. The brassiere of claim 1 wherein said non-elastic material is fiberfill.

5. The brassiere of claim 1 wherein said yoke is chevron-shaped.

6. The brassiere of claim 1 additionally comprising underwire support means extending through said lower margin and into said inner and outer side margins.

7. The brassiere of claim 1 wherein said segment and said yoke of said inner cup are connected without overlapping.

8. The brassiere of claim 1 wherein during use of said brassiere said outer cup conceals the connection of said segment and said yoke of said inner cup.

9. The brassiere of claim 1 additionally comprising shoulder strap means for connecting said upper margins of each of said bra cups to said back band means over the shoulders of the wearer.

10. The brassiere of claim 1 wherein said inner and outer cups of each of said cups are coextensive.

11. In a brassiere comprising (A) two bra cups, each including an inner cup and an outer cup peripherally joined together to form upper, lower, inner side and outer side margins;

(B) back band means for connecting said outer side margins of said bra cups about the back of the wearer;

(C) chest band means for connecting said inner side margins of said bra cups in the front of the wearer; and (D) shoulder strap means for connecting said upper margins of each of said bra cups to said back band means over the shoulders of the wearer;

the improvement wherein said inner and outer cups of each of said bra cups are coextensive; each of said outer cups is formed of elastic material; and each of said inner cups comprises a segment formed of non-elastic material extending upwards from said lower margin and a yoke formed of elastic material connecting the top and sides of said non-elastic segment to said upper, inner side and outer side margins, said non-elastic segment comprising at least 50 percent of the total area of said inner cup and extending above the bra cup point; whereby said elastic yoke of said inner cup permits said outer cup to accommodate to the breast of the wearer, said non-elastic segment of said inner cup provides support in the medial region thereof, and said outer cup conceals the connection of said inner cup segment and yoke during use of the brassiere.

12. In a brassiere of the type including two bra cups, each including an inner cup and an outer cup peripherally joined together; the improvement comprising each of said outer cups formed of elastic material, and each of said inner cups including a segment formed of non-elastic material and a suspending yoke formed of elastic material connected to said non-elastic segment; whereby said elastic yoke of said inner cup permits said outer cup to accommodate to the breast of the wearer while said non-elastic segment of said inner cup provides breast support.

13. A brassiere comprisng two bra cups, each including an inner cup and an outer cup peripherally joined together, said inner and outer cups being substantially coextensive; each of said outer cups being formed of elastic material, and each of said inner cups including a segment formed of non-elastic material and a suspending yoke formed of elastic material connected to said non-elastic segment, said non-elastic segment extending over at least 50 percent of the total area of said inner cup, and said suspending yoke enabling said outer cup to accommodate to the breast of the wearer with said non-elastic segment providing breast support.

* * * * *